United States Patent [19]

Reider

[11] 4,364,522

[45] Dec. 21, 1982

[54] HIGH INTENSITY AIR BLAST FUEL NOZZLE

[75] Inventor: Samuel B. Reider, Indianapolis, Ind.

[73] Assignee: General Motors Corporation, Detroit, Mich.

[21] Appl. No.: 170,682

[22] Filed: Jul. 21, 1980

[51] Int. Cl.[3] ..... B05B 7/00

[52] U.S. Cl. ..... 239/399

[58] Field of Search ..... 239/399, 400, 401, 402, 239/403, 404, 405, 406, 431, 432, 434, 434.5; 60/740, 748

[56] References Cited

U.S. PATENT DOCUMENTS

| | | | |
|---|---|---|---|
| 2,959,003 | 11/1960 | Carlisle et al. | 60/748 |
| 3,608,831 | 9/1971 | Place et al. | 239/406 |
| 3,713,588 | 1/1973 | Sharpe | 239/400 |
| 4,018,554 | 4/1977 | Teodorescu et al. | 239/406 |

*Primary Examiner*—James B. Marbert
*Attorney, Agent, or Firm*—J. C. Evans

[57] ABSTRACT

An air blast nozzle includes a ring of air swirler vanes therein for producing a first turbulent flow of air therethrough and a turbulence generator located within the air flow through said swirler vanes to produce an intensification of the turbulent flow of the air swirl produced by the swirler vanes. The intensified swirled air is immediately directed into mixed flow relationship with fuel from said air blast nozzle to maintain increased turbulence intensity at the fuel from said nozzle without attenuation of the air energy level prior to burning of the air/fuel mixture so as to improve combustor efficiency by evaporation rate control due to decreased fuel droplet size attributable to the turbulence intensification.

5 Claims, 7 Drawing Figures

HIGH INTENSITY AIR BLAST FUEL NOZZLE

This invention relates to air blast fuel nozzles and, more particularly, to air blast fuel nozzles for reducing fuel droplet size to increase air/fuel combustion efficiency.

Various air blast fuel nozzle injection devices have been proposed wherein fuel spray from a nozzle is injected into a swirled air stream produced by a cascade of swirler vanes located on the outer perimeter of the nozzle immediately upstream of the fuel spray cone therefrom. It has been shown that such cascades of swirler vanes will decrease the size of fuel spray droplets. Since combustion efficiency is evaporation rate controlled, fuel droplet size reduction can increase combustion efficiency.

An object of the present invention is to improve air blast fuel nozzles with a cascade of swirler vanes by the provision of associated means for imposing a further itensification of air flow turbulence within the cascade of swirler vanes so that as swirler air is mixed with a nozzle fuel the size of fuel droplets is reduced to improve fuel atomization.

Another object of the present invention is to provide an improved air blast fuel nozzle with a cascade of swirler vanes for swirling air for mixing with nozzle fuel by the provision of a turbulence generator located in air flow through the cascade of swirler vanes so as to produce intense air flow turbulence in outlet air flow from the cascade of swirler vanes at a point where it is mixed with nozzle fuel flow so that the size of the fuel droplets will be reduced to improve fuel atomization.

Still another object of the present invention is to improve a combustor having air and fuel supplied thereto by an airblast nozzle assembly including a nozzle for directing fuel into the reaction zone of the combustor, and including a cascade of swirler vanes surrounding the nozzle with an outlet for directing an air swirl pattern into fuel flow from the nozzle by the provision of a turbulence generator located between the inlet to the cascade of swirler vanes and the outlet thereof to produce an intense turbulence within the air swirl pattern through the vanes so as to produce an intensification of turbulence at the point of mixture of air with the fuel thereby to reduce the size of fuel droplets so as to improve fuel atomization.

Another object of the invention is to provide an air/fuel supply system for a combustor of the type set forth in the preceding object wherein the turbulence intensifier is a grid located across the inlet edge to the swirler vanes of the airblast fuel nozzle.

Yet another object of the invention is to provide an airblast nozzle assembly for supplying air/fuel mixtures to a combustor, the assembly including a fuel supply nozzle for directing fuel into a reaction zone of a combustor and wherein the nozzle includes a cascade of swirler vanes having a plurality of separate vanes, each vane including perforations therein for producing streams of flow between the suction and pressure surfaces of each of the vanes to produce intensification of turbulence in swirling air flow through the cascade of vanes so that a highly turbulent air flow will be directed from the cascade of vanes at its outlet for mixture with fuel flow from the nozzle so as to reduce fuel droplet size for improved fuel atomization.

These and other objects and advantages of the present invention will become more apparent when reference is made to the following detailed description and accompanying drawings, wherein.

Figure 4:
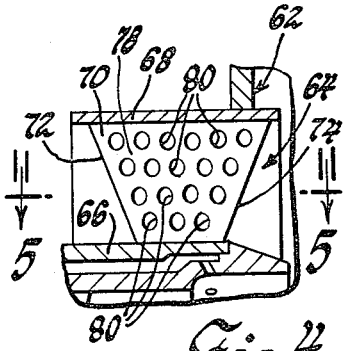
FIG. 4 is a fragmentary, cross sectional view of another embodiment of an air blast fuel nozzle including the present invention.
Figure 5:
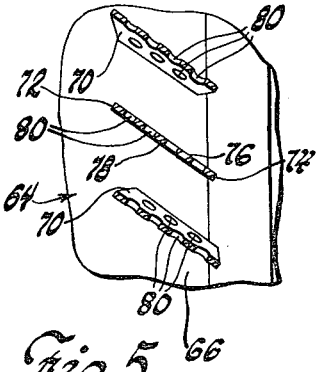
Figure 6:
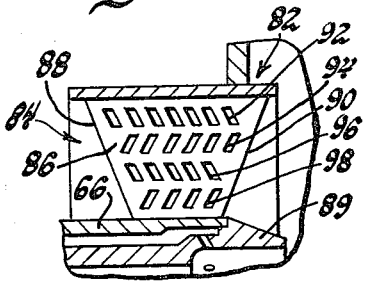
Figure 7:
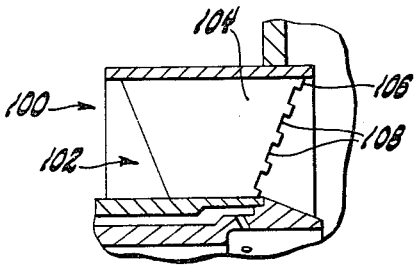

FIG. 5 is a cross sectional view taken along the line 5—5 of FIG. 4 and looking in the direction of the arrows 4—4; and FIGS. 6 and 7 are fragmentary cross sectional views of still other embodiments of an air blast fuel nozzle including the present invention.

Referring now to the drawing an air blast fuel nozzle assembly 10 with integral components is shown in FIGS. 1-5. The air blast fuel nozzle assembly 10 includes an internally located pilot fuel nozzle 12 supplied by a pilot fuel tube 14. Pilot fuel nozzle 12 includes an outlet orifice 16 to produce a spray cone of fuel 18. Air for atomizing the spray cone of fuel 18 crosses a cascade of swirler vanes 20 formed between the outer annular surface 22 of the pilot fuel nozzle 12 and the inner surface 24 of an annular wall 26 that forms part of a main fuel passage 28. Passage 28 communicates with a plurality of tangential outlet orifices 30 from a fuel header 32 at the outlet 34 of the air blast fuel nozzle assembly 10. The air blast fuel nozzle assembly 10 further includes an additional air blast swirler 36 including a cascade of swirler vanes 38. Each vane 38 has a base 40 thereon connected to an outer annular wall 26 of main fuel passage 28 and each vane 38 is connected at its outer tip 42 to inner surface 44 of an annular shroud 46. Hence, primary air is directed across each vane 38 from a leading edge 48 thereof to a trailing edge 50 thereof to produce an air-swirl pattern which mixes with main fuel flow from header 32. Shroud 46 is supported with respect to a downstream combustion zone 52 from a combustor wall 54.

Such cascades of swirler vanes 20, 38 are included to provide a homogenous mixture of fuel droplets from the spray cone 18 and the air swirl which is directed from the trailing edge 50 of each of the vanes 38 to mix with fuel from orifices 30 at the outlet 34. In the design of such air blast fuel nozzle assemblies 10, the velocity of the air swirl atomizes the fuel. The size of the atomized fuel droplets can be correlated directly to combustion efficiency by the expression: $\eta_c \alpha$ (1/D) 1.5 where $\eta_c$ is combustor efficiency and D is the diameter of a fuel droplet. Accordingly, it can be seen that smaller fuel droplets result in greater combustion process efficiency within the combustion zone 50.

Since the size of a fuel droplet is a function of the air flow velocity and turbulence level in accordance with the present invention, means are provided in association with the swirlers 20, 36 to decrease the droplet size by increasing the turbulence intensity in the air swirl pattern which intermixes with the fuel to produce a finely divided homogenous air/fuel mixture for combustion within a combustion zone.

A wire grid turbulence generator 56 is located upstream of the cascade of swirler vanes 20 to increased turbulence intensity in the air flow through a pilot air passage 58 of a length selected to insure that the increase in turbulence of air flow across the swirler vanes 20 will be maintained without attenuation. Improved mixing and atomization of the air/fuel flow from the outlet of pilot fuel nozzle results. If desired, a perforated plate turbulence generator 60 can be located at the inlet of the air blast swirler 36 to produce increased turbulence intensity in the air being mixed with the main fuel flow from header 32.

Figure 1:
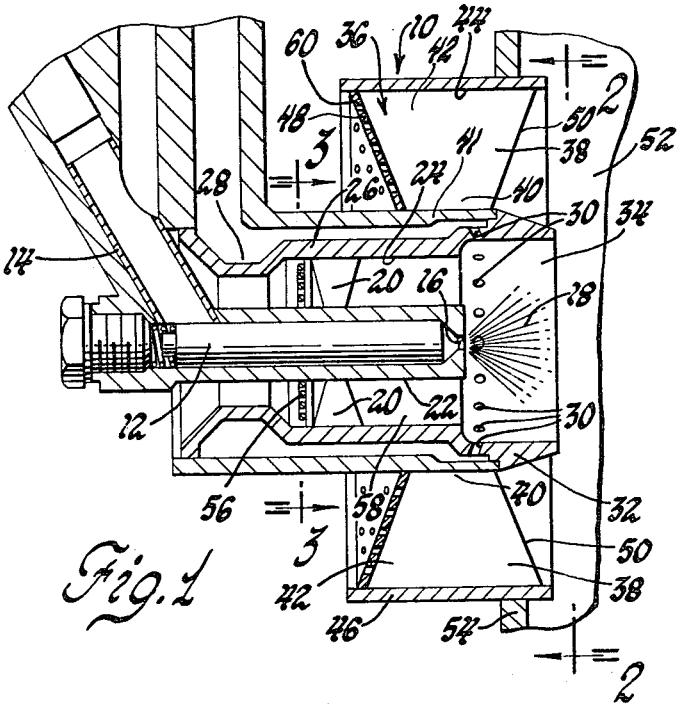
FIG. 1 is a longitudinal sectional view of an air blast fuel nozzle including the present invention.
Figure 2:
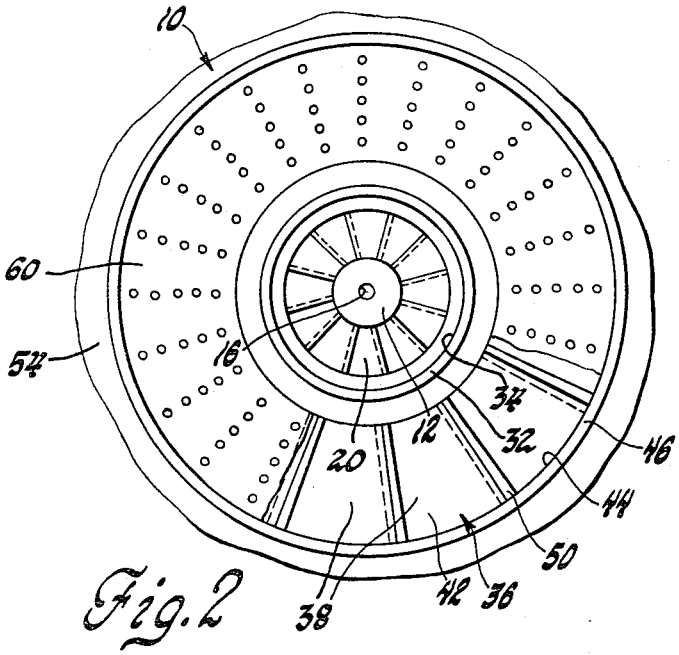
FIG. 2 is an enlarged cross sectional view of the air blast nozzle assembly taken along the line 2—2 of FIG. 1.
Figure 3:
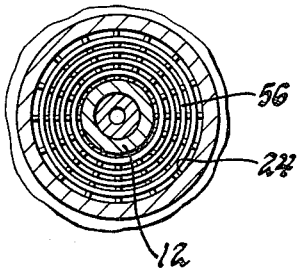
FIG. 3 is a cross sectional view taken along the line 3—3 of FIG. 1 and looking in the direction of the arrows.

It is readily apparent that one or both of the cascades of swirlers 20, 36 in the embodiment of the invention shown in FIGS. 1–3 can be associated with any one of the other aforedescribed embodiments of the present invention to produce increased turbulence intensity that is matched for a particular air/fuel mixture to be supplied to the reaction zone of a combustor.

In the embodiment shown in FIGS. 4 and 5 a nozzle 62 of the air blast type corresponding to the nozzle 10 of the first embodiment includes a main air flow swirler 64 for directing combustion air into a combustion zone. The swirler 64 includes inner and outer spaced annular walls 66 and 68 joined by a cascade of swirler vanes 70. Each vane 70 has a leading edge 72 and a trailing edge 74. As shown in FIG. 5, each of the vanes 70 includes a suction surface 76 and a pressure surface 78 which are intercommunicated by a plurality of cross-over holes 80. Thus, as air is directed into the swirler 64 across the vane leading edges 72, it will be swirled and further agitated as it flows from the vane pressure surface 78 through holes 80 to the vane suction surface 76. Resultant turbulence generation across each of the vanes 70 will maintain high energy unsteady state components in the air flow field entering the combustion zone. A more homogenous air/fuel mixture with reduced diameter fuel droplets is produced in accordance with the present invention.

A further embodiment is illustrated in FIG. 6 as including an air blast fuel nozzle 82 for directing fuel into a combustion zone. Nozzle 82 includes a swirler 84 having a cascade of swirler vanes 86. Each vane 86 has a leading edge 88 and a trailing edge 90 for directing primary air flow as a swirled pattern for mixtures with the fuel flow from a tangential fuel header 89. A plurality of cross-inclined slots 92, 94, 96 and 98 are formed through each of the vanes 86. The slots 92, 94, 96, 98 constitute a plurality of micro-vortex generators from the pressure surface of each of the vanes 86 to an opposite suction surface. The resultant vortex formation increases turbulence intensity within the primary air flow through the swirler vanes 86.

Yet another embodiment of the invention is shown in FIG. 7, wherein an air blast fuel nozzle 100 has a main combustion air swirler 102. Each of a plurality of vanes 104 in the swirler 102 includes a trailing edge 106 immediately upstream of the outlet from the swirler 102. Each of the trailing edges 106 is notched to define a plurality of vertically spaced grooves or end slots 108. The end slots 108 produce intensified turbulence in the air swirl pattern as it is directed from the swirler 102.

Further objects and advantages of the present invention, as herein disclosed, constitute a preferred form, it is to be understood that other forms might be adopted.

The embodiments of the invention in which an exclusive property or privilege is claimed are defined as follows:

1. In an air blast fuel nozzle including a cascade of swirler vanes defining a plurality of combustion air passages for directing a swirling flow of air to a combustion chamber and means in said fuel nozzle defining at least one fuel port for supplying an unburned source of fuel to said swirling flow of air, the improvement comprising, turbulence generator means located within the air flow through said combustion air passages and operative to produce an intensification of turbulence in said swirling flow of air immediately prior to mixing of said swirling flow of air with said unburned fuel source and to maintain said increased turbulence intensity without attenuation of the energy level in said swirling flow of air prior to mixing with said unburned fuel source thereby to cause reduction in fuel droplet size prior to burning of the fuel/air mixture so as to improve combustion efficiency by evaporation rate control attributable to the decreased fuel droplet size as produced by the turbulence intensification.

2. In an air blast fuel nozzle including a cascade of swirler vanes defining a plurality of combustion air passages for directing a swirling flow of air to a combustion chamber and means in said fuel nozzle defining at least one fuel port for supplying an unburned source of fuel to said swirling flow of air, the improvement comprising, a wire grid located upstream of the swirler vanes across the air flow through said combustion air passages operative to produce an intensification of turbulence in said swirling flow of air immediately prior to mixing of said swirling flow of air with said unburned fuel source and to maintain said increased turbulence intensity without attenuation of the energy level in said swirling flow of air prior to mixing with said unburned fuel source thereby to cause reduction in fuel droplet size prior to burning of the fuel/air mixture so as to improve combustion efficiency by evaporation rate control attributable to the decreased fuel droplet size as produced by the turbulence intensification.

3. In an air blast fuel nozzle including a cascade of swirler vanes defining a plurality of combustion air passages for directing a swirling flow of air to a combustion chamber and means in said fuel nozzle defining at least one fuel port for supplying an unburned source of fuel to said swirling flow of air, the improvement comprising, a perforated plate turbulence intensifier located within the air flow through said combustion air passages operative to produce an intensification of turbulence in said swirling flow of air immediately prior to mixing of said swirling flow of air with said unburned fuel sources and to maintain said increased turbulence intensity without attenuation of the energy level in said swirling flow of air prior to mixing with said unburned fuel source thereby to cause reduction in fuel droplet size prior to burning of the fuel/air mixture so as to improve combustion efficiency by evaporation rate control attributable to the decreased fuel droplet size as produced by the turbulence intensification.

4. In an air blast fuel nozzle including a cascade of swirler vanes defining a plurality of combustion air passages for directing a swirling flow of air to a combustion chamber, each of said swirler vanes including a suction surface and a pressure surface, and means in said fuel nozzle defining at least one fuel port for supplying an unburned source of fuel to said swirling flow of air, the improvement comprising, a plurality of holes on each of said swirler vanes intercommunicating said suction and said pressure surfaces for flow therebetween, said holes defining turbulence generator means located within the air flow through said combustion air passages operative to produce an intensification of turbulence in said swirling flow of air immediately prior to mixing of said swirling flow of air with said unburned fuel source and to maintain said increased turbulence intensity without attenuation of the energy level in said swirling flow of air prior to mixing with said unburned fuel source thereby to cause reduction in fuel droplet size prior to burning of the fuel/air mixture so as to improve combustion efficiency by evaporation rate control attributable to the decreased fuel droplet size as produced by the turbulence intensification.

5. In an air blast fuel nozzle including a cascade of swirler vanes defining a plurality of combustion air passages for directing a swirling flow of air to a combustion chamber, each of said swirler vanes having a trailing edge, and means in said fuel nozzle defining at least one fuel port for supplying an unburned source of fuel, to said swirling flow of air, the improvement comprising, means on each of said swirler vanes at said trailing edges thereof defining slots at spaced locations along said trailing edges, said slots defining turbulence generator means located within the air flow through said combustion air passages operative to produce an intensification of turbulence in said swirling flow of air immediately prior to mixing of said swirling flow of air with said unburned fuel source and to maintain said increased turbulence intensity in said swirling flow of air without attenuation of the energy level prior to mixing with said unburned fuel source thereby to cause reduction in fuel droplet size prior to burning of the fuel/air mixture so as to improve combustion efficiency by evaporation rate control attributable to the decreased fuel droplet size as produced by the turbulence intensification.

* * * * *